United States Patent [19]

Toda et al.

[11] Patent Number: 5,036,369

[45] Date of Patent: Jul. 30, 1991

[54] IMAGE FORMING APPARATUS

[75] Inventors: Kunio Toda; Tomoaki Yokoyama; Taisuke Nagao, all of Osaka, Japan

[73] Assignee: Minolta Camera Kabushiki Kaisha, Osaska, Japan

[21] Appl. No.: 372,817

[22] Filed: Jun. 29, 1989

[30] Foreign Application Priority Data

Jun. 30, 1988 [JP] Japan ..... 63-162865
Jun. 30, 1988 [JP] Japan ..... 63-162866

[51] Int. Cl.[5] ..... G03G 21/00

[52] U.S. Cl. ..... 355/298; 118/652; 118/657; 355/245; 355/251; 355/269

[58] Field of Search ..... 355/297, 298, 269, 270, 355/245, 251, 253, 326, 246, 328; 118/652, 657, 658, 661

[56] References Cited

U.S. PATENT DOCUMENTS

| | | | |
|---|---|---|---|
| 3,678,896 | 7/1972 | Hewitt . | |
| 4,500,198 | 2/1985 | Daniels | 355/270 |
| 4,660,960 | 4/1987 | Fukunaga et al. | 355/245 X |
| 4,696,565 | 9/1987 | Imanaka | 355/298 |
| 4,752,805 | 6/1988 | Fukae et al. | 355/298 |
| 4,814,820 | 3/1989 | Hirahara et al. | 355/253 |
| 4,827,869 | 5/1989 | Takagi | 355/326 X |
| 4,862,216 | 8/1989 | Higashi et al. | 355/245 X |
| 4,866,486 | 9/1989 | Higashio et al. | 355/326 |

FOREIGN PATENT DOCUMENTS

| | | | |
|---|---|---|---|
| 57-661 | 1/1982 | Japan . | |
| 0079980 | 5/1982 | Japan | 355/298 |
| 0156081 | 8/1985 | Japan | 355/298 |
| 0159875 | 7/1988 | Japan | 355/269 |

*Primary Examiner*—A. T. Grimley
*Assistant Examiner*—Matthew S. Smith
*Attorney, Agent, or Firm*—Burns, Doane, Swecker & Mathis

[57] ABSTRACT

An image forming apparatus includes a photosensitive member rotatably supported; an upstream developing device, in a rotary direction of the member, for developing an electrostatic latent image corresponding to a solid image and/or a literal image with an accommodated developer therein; a downstream developing device, in the direction thereof, for developing an electrostatic latent image corresponding to a line image with an accommodated developer in the same color as that in the upstream developing device; a cleaning device for collecting the developer remained on the surface of the member; and a developer transporting device for transporting the developer collected by the cleaning device to the upstream developing device. The apparatus further includes a charging device for charging a specified zone of the surface of the member; an image forming device for forming the latent image on the charged specified zone thereof; a voltage changing device for selecting one of a first developing bias voltage and a second developing bias voltage which is higher than the first developing bias voltage; and a control device for controlling the voltage changing device. By the control device, the first developing bias voltage is applied to the upstream developing device while the latent image on the specified zone of the member passes through a developing region of the upstream developing device and the second developing bias voltage is applied thereto while the specified zone passes therethrough again after the latent image passes therethrough.

14 Claims, 8 Drawing Sheets

*Fig. 7*

| | VII | VIII | IX |
|---|---|---|---|
| Rank (Good) 5 4 3 2 1 (Bad) | | | |
| RSI | 1.47 | 0.62 | 1.48 |
| Developing Condition | Only Device 1<br>$Ds_1$=0.4mm<br>$Db_1$=0.5mm<br>$P.D._1 > P.D._2$ | Only Device 2<br>$Ds_2$=1.2mm<br>$Db_2$=0.45mm<br>← | Both Device 1 and 2<br>← |

△: Line of 100μm width

○: Line of 50μm width

IMAGE FORMING APPARATUS

BACKGROUND OF THE INVENTION

The present invention generally relates to an image forming apparatus in which an image is reproduced by plural developing devices arranged at the side of a photosensitive member.

Conventionally, as one example of an image forming apparatus as described above, there has been proposed an image forming apparatus in which a magnetic brush type two-component developer, composed of a toner and a carrier, held on the surface of a developing sleeve, is contacted with the surface of a photosensitive member to be electrostatically supplied to an electrostatic latent image on the member.

In this kind of apparatus, developer packaged density (P.D.) at a developing region confronting the sleeve with the member is defined by an equation which is $$P.D. = Vd/Ds,$$

where Vd is an amount of the developer passed through the region per hour and Ds is a distance between the sleeve and the member. The density (P.D.) has a great effect on the quality of a reproduced image. That is, higher developer packaged density results in improved reproducibility RSI of the density of a reproduced solid image and/or a reproduced normal literal image and worse reproducibility RLI of the density of a line image, which indicates limited density of reproducibility of an original image with 50 μm width when the line image is reproduced as a line. Conversely, lower packaged density results in worse reproducibility RSI of the density of the reproduced solid image and/or the reproduced normal literal image and improved reproducibility RLI of the density of the line image.

In other words, in the apparatus, the reproducibility RSI of the density of the solid image and/or the normal literal image conflicts with the reproducibility RLI of the density of the line image. That is, the former has priority of development over that of the latter to deteriorate the latter. The latter has priority of development over that of the former to deteriorate the former. Then, the quality of the reproduced image depends on the packaged density (P.D.).

Therefore, conventionally, it has been impossible for both of the reproducibility RSI and RLI of the density to simultaneously improve by only one developing device.

Then, in order to provide an image forming apparatus in which both the reproducibility RSI and RLI are improved, at least two developing devices are required. However, consumption amount of the toner in the developer in a case where the reproducibility RSI has priority over that of the reproducibility RLI is larger than that in a case where the reproducibility RLI has priority, over that of the reproducibility RSI, and thus, a large amount of toner are is replenished to the developing device with the priority for the reproducibility RSI. Furthermore, recently, there has been required to provide a miniature image forming apparatus, and then, the apparatus with both of the reproducibility RSI and RLI improved is needed to satisfy such a requirement.

SUMMARY OF THE INVENTION

Accordingly, an essential object of the present invention is to provide an image forming apparatus in which both of the reproducibility RSI and RLI are improved in which an operation for replenishing a developing device, having priority for reproducibility RSI to consume a large amounts of toner, with a toner may reduce to effectively use the toner.

Another object of the present invention is to provide an image forming apparatus which is smaller in size.

In accomplishing these and other objects, according to the present invention, there is provided an image forming apparatus comprising:

- a photosensitive member supported to rotate in one direction;
- a first developing means accommodating a developer in a specified color and set to develop an electrostatic latent image corresponding to at least a literal image;
- a second developing means arranged at a downstream side of the first developing means in the one direction of the member, the second developing means accommodating a developer in the same color as that in the first developing means and being set to develop an electrostatic latent image corresponding to a line image;
- a cleaning means for collecting the developer remained on a surface of the member; and
- a developer transporting means for transporting the developer collected by the cleaning means to the first developing means.

By the arrangement according to the present invention, both the developing means may be simultaneously driven for development to obtain a reproduced image with an improvement of reproducibility of density of at least a line image, that is, a solid image and/or a line image, the used developer is collected by the cleaning means and is transported, by the developer transporting means, to the first developing means consumes a larger amount of developer than the second developing means to be effectively used by the first developing means without useless waste of the developer.

In another aspect of the present invention, the image forming apparatus comprises:

- a photosensitive member supported to rotate in one direction;
- a charging means for uniformly charging a specified zone of a surface of the member;
- an image forming means for forming an electrostatic latent image on the uniformly charged specified zone of the surface of the member;
- a first developing means accommodating a developer in a specified color and set to develop at a developing region thereof an electrostatic latent image corresponding to at least a literal image under applying a first developing bias voltage thereto;
- a voltage changing means for selecting one of the first developing bias voltage in the first developing means and a second developing bias voltage which is higher than the first developing bias voltage and applying the selected voltage to the second developing device;
- a second developing means arranged at a downstream side of the first developing means in the one direction of the member, the second developing means accommodating a developer in the same color as that in the first developing means and being set to develop an electrostatic latent image corresponding to a line image; and a control means for controlling such an operation of the voltage changing means that the first developing voltage is applied to the first developing means thereby while the latent image formed on the specified zone of the surface of the member passes through the developing region of the first developing means and that the second developing voltage is applied to the first developing means thereby while the specified zone passes through the developing region of the first developing means after the latent image passes through the region of the first developing means.

By the arrangement according to the present invention, since a cleaning device is not necessary to be arranged at the side of the photosensitive member, a space for arranging the cleaning device is unnecessary even though plural developing means are arranged at the side of the member to obtain a high quality image, so that the apparatus is smaller in size.

BRIEF DESCRIPTION OF THE DRAWINGS

These and other objects and features of the present invention will become clear from the following description taken in conjunction with the preferred embodiments thereof with reference to the accompanying drawings, in which:

FIG. 7 is a graph of the result in the experiment 3;

DETAILED DESCRIPTION OF THE INVENTION

Figure 1:
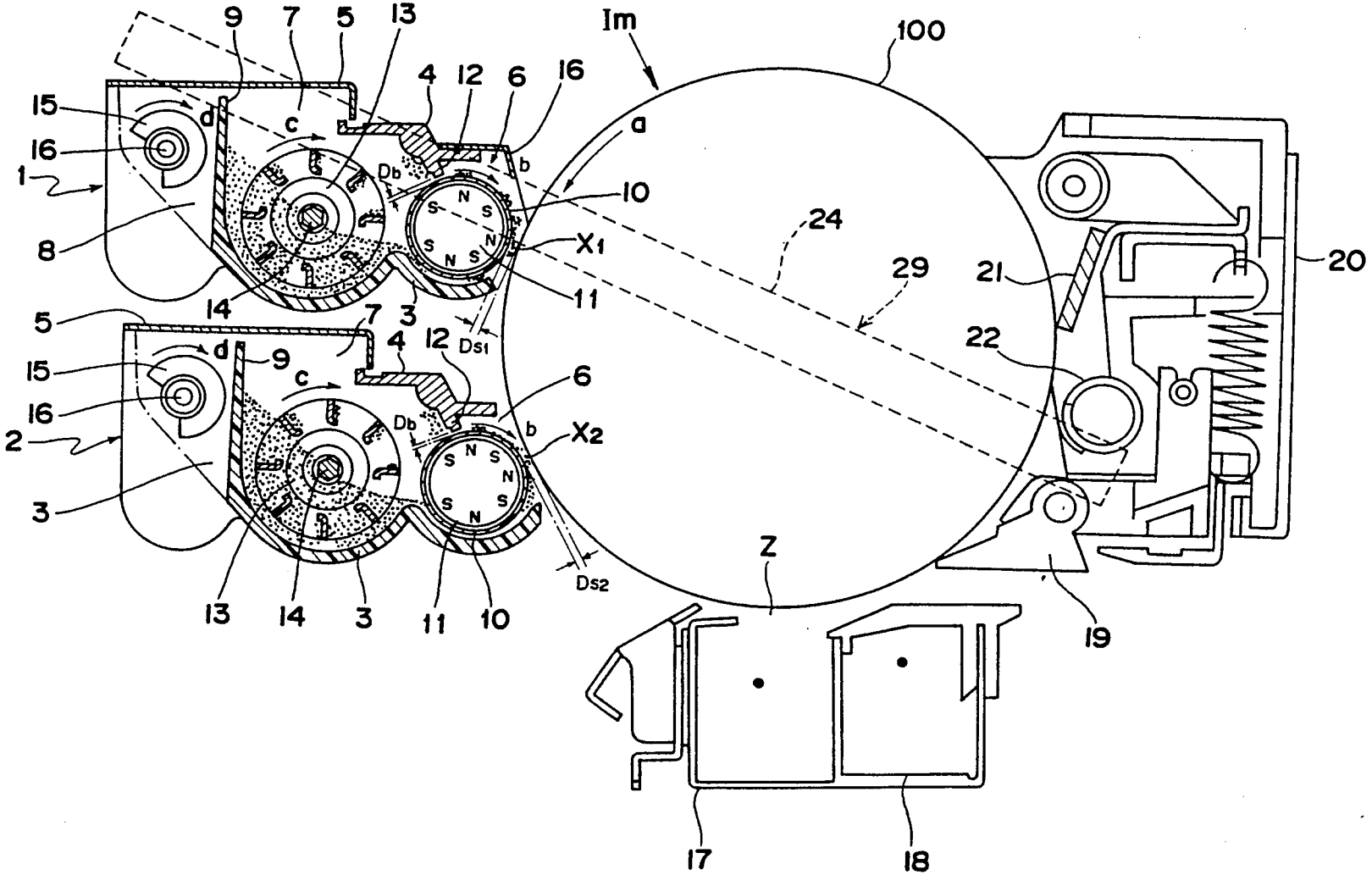
FIG. 1 is a sectional view of a main part of an image forming apparatus according to the first embodiment of the present invention.

Before the description of the present invention proceeds, it is to be noted that like parts are designated by like reference numerals throughout the accompanying drawings.

FIGS. 1–4 show an image forming apparatus according to the first embodiment of the present invention. FIG. 1 shows a main part of the apparatus including other devices such as a copying apparatus and a printer for employing an electrophotocopy process. Reference numeral 100 denotes a photosensitive drum having a photosensitive layer at the outer surface thereof and being driven for rotation in a direction shown by an arrow (a) in FIG. 1, 1 and 2 a first and second developing devices, 17 a transfer charger, 18 a separating charger, 19 a separating claw, 20 a cleaning device, and 29 a toner transporting device.

The construction of the developing devices 1 and 2 are the same except for some parts. A housing of each of the devices 1 and 2 is constructed of a bottom casing 3, an upper casing 4, and a cover 5 for opening and closing. In a space formed by the housing, a developing unit 6 and transporting paths 7 and 8 are disposed toward the left side from the drum 100 in FIG. 1. The paths 7 and 8 are separated from each other by a partition 9. In the devices 1 and 2, an end path (not shown) is, respectively, formed at this side and that side in FIG. 1, that is, between the inner surface of each of the devices 1 and 2 and each side end of the partition 9, to connect the path 7 with the path 8 therethrough.

In the developing unit 6, a developing sleeve 10 is disposed near the drum 100, and is supported to be driven for rotation in a direction shown by an arrow (b) while confronting with the drum 100 through small developing gaps $Ds_1$ and $Ds_2$.

A developer height regulating member 12 formed on the upper casing 4 confronts the upper portion of the outer circumferential surface of each of the sleeves 10 through a small height regulating gap Db.

Developing bias voltages $V_{B1}$ and $V_{B2}$ of a power source (not shown) are applied to the sleeves 10 in the devices 1 and 2, respectively.

In each sleeve 10, a magnetic element 11 is fixedly accommodated to be independent of the inner surface of the sleeve 10. At the outer circumferential portion of the element 11 are disposed plural magnetic poles. At a portion, confronting the path 7, of the element 11 are adjacently disposed the same south poles S.

In the path 7, a bucket roller 13 is rotatably supported by a shaft 14 to be driven for rotation in a direction shown by an arrow (c). In the path 8, a screw 15 is rotatably supported by a shaft 16 to be driven for rotation in a direction shown by an arrow (d).

In the device 1 disposed at the upstream side of the drum 100, a sleeve cover 16 for covering the upper portion of the sleeve 10 is disposed at the distal end of the upper casing 4. The developing gap $Ds_1$ of the device 1 is smaller than that $Ds_2$ of the device 2. Then, developer packaged density ($P.D._1$) at the developing region $X_1$ confronting the sleeve 10 in the device 1 with the drum 100 is larger than that ($P.D._2$) at the developing region $X_2$ confronting the sleeve 10 in the device 2 with the drum 100.

The developing packaged density (P.D.) is defined by an equation, which is $$P.D. = Vd/Ds,$$

where Vd is an amount of a developer passed through the developing region per hour, and Ds is the developing gap.

In the devices 1 and 2 each having the arrangement, the two-component developer composed of a toner and a carrier is accommodated into both of the paths 7 and 8 in each of the devices 1 and 2. The developer is circularly transported in the paths 7 and 8 through the end paths (not shown) formed between the side ends of the partition 9 and the inner surface of each of the devices 1 and 2 on the basis of rotation of the bucket roller 13 and the screw 15. That is, for example, the developer in the path 7 is transported by the bucket roller 13 from that side to this side in FIG. 1. At the end of this side, the developer is transported into the path 8 through one of the end paths (not shown). On the other hand, the developer in the path 8 is transported from this side to that side in FIG. 1 by the screw 15. At the end of that side, the developer is transported into the path 7 through the other end path (not shown).

Thus, the transportation of the developer causes the toner and the carrier of which the developer is composed to charge into different polarities with friction contact therebetween.

The developer transporting in the path 7 is transported to the sleeve 10 while transporting as described above on the basis of rotation of the bucket roller 13. Then, the developer is held on the outer circumferential portion of the sleeve 10 by the magnetic force of the magnetic element 11.

The developer held on the sleeve 10 is transported in the direction shown by the arrow (b) on the basis of rotation of the sleeve 10 so that the transporting amount of the developer is regulated by the portion, confronting with the sleeve 10, of the regulating member 12.

The developer passes through the height regulating gap Db and is transported in the direction shown by the arrow (b) while forming a magnetic brush along a magnetic line of force which is formed by the plural magnetic poles, and then, is transported to each of the developing regions $X_1$ and $X_2$ where the sleeves 10 confront with the drum 100.

The developer which has passed through each of the regions $X_1$ and $X_2$ is consequentially transported in the direction shown by the arrow (b). Then, when the developer reaches a position confronting the transporting path 7, it is released from a restraint of the magnetic element 11 by a repulsion magnetic field formed by the adjacent south poles S and S to be fallen down from the surface of the sleeve 10 in the path 7.

The developer which has fallen in to the path 7 is taken into the developer transporting by the bucket roller 13 while mixing and agitating with thereby.

In the first developing device 1, the sleeve cover 16 is arranged to prevent toner smoke from splashing which is caused by the developer held on an outer circumferential portion of the sleeve 10.

Figure 2:
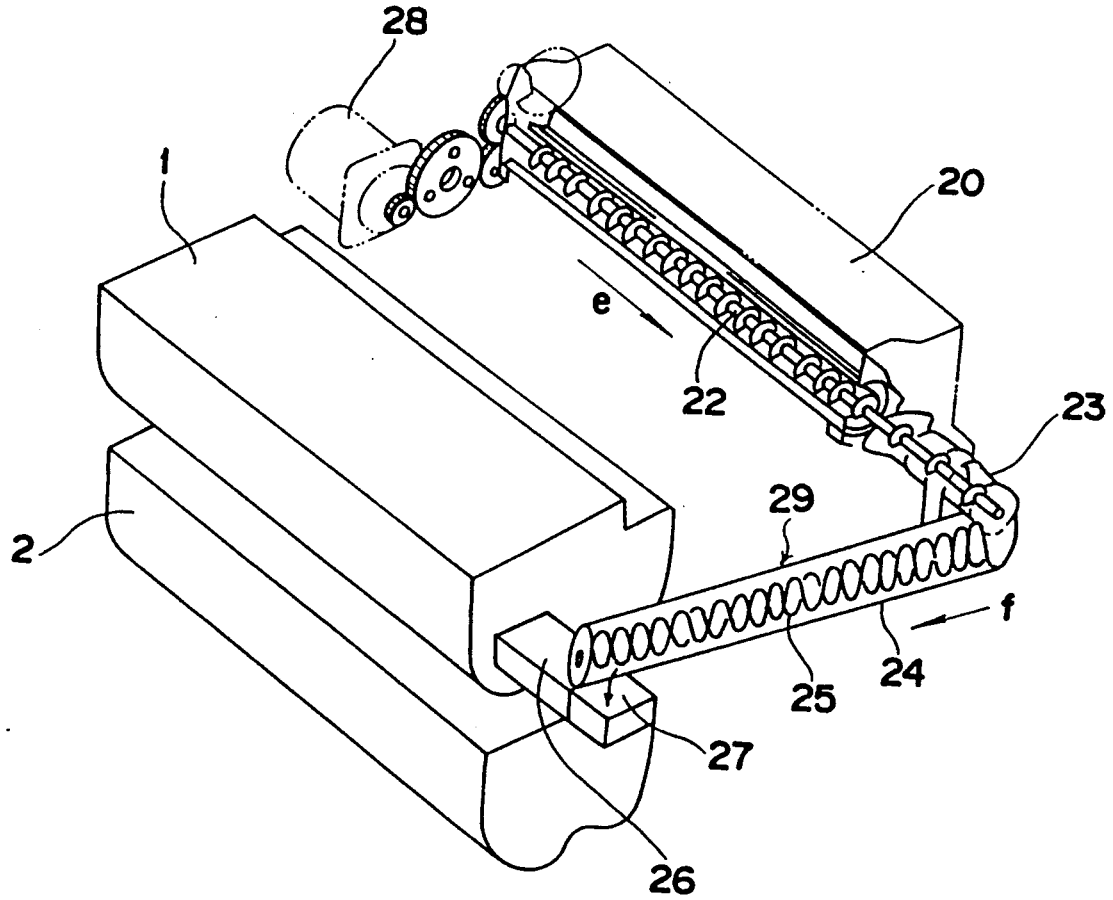
FIG. 2 is a perspective view of a toner transporting device in the apparatus.

By the toner transporting device 29, used toner collected by the cleaning device 20 is transported to the first developing device 1. As shown in FIG. 2, a screw 22 disposed in the cleaning device 20 is arranged in a transporting path 23 disposed at a side casing of the cleaning device 20. A transporting pipe 24 accommodating a screw 25 is arranged at a portion from the side of the cleaning device 20 to the side of the first developing device 1. One end of the pipe 24 is connected with the transporting path 23 and a drop opening (not shown) formed at the other end of the pipe 24 is positioned above a used toner replenishment opening 27 of a replenishment path 26 formed extending from the side of the device 1 along the path 7 therein. The screws 22 and 25 are driven for rotation by a motor 28.

In the apparatus comprising the devices 1 and 2 having the above-described arrangement, the devices 1 and 2 accommodating the toner in the same color are driven as described below.

A specified zone of the surface of the drum 100 which is charged by a corona charger (not shown) is exposed by an image light (Im) to form an electrostatic latent image thereon.

The latent image is subjected to the toner supplied from the device 1 at the region $X_1$ of the device 1.

Here, as described above, since the packaged density ($P.D._1$) at the region $X_1$ is larger than that ($P.D._2$) at the region $X_2$, the toner in the device 1 is frequently contacted with the latent image to be sufficiently supplied thereto for development.

The toner attached to an electrostatic latent image of a line image is often scraped off by the magnetic brush and thus little toner is attached to the latent image of the line image passed through the region $X_1$. After the toner attached to the latent image is scraped off, the latent image has still been maintained in a charging state.

Next, the latent image transported to the region $X_2$ is subjected to the toner in the same color as that in the first developing device 1, which is supplied from the second developing device 2, so that the toner in the device 2 is supplied to the toner image formed at the region $X_1$.

Then, the toner in the device 2 is supplied to the latent image of the line image by the device 2 to which the toner attached is scraped off by the magnetic brush at the region $X_1$.

Since the packaged density ($P.D._2$) at the region $X_2$ is smaller than that ($P.D._1$) at the region $X_1$, the toner attached to the latent image is seldom scraped off by the magnetic brush, the latent image of the line image passes through the region $X_2$ while the toner sufficient to be developed into a visible image is attached to the latent image of the line image.

Therefore, most of literal images and solid images are reproduced with the sufficient density thereof and the line image is reproduced as a line image sufficient to be visible.

Then, the toner image developed into a visible image is transported to a position Z confronting the transfer charger 17 to be transferred onto a copy paper (not shown) transporting in a specified timed relation with respect to the toner image.

The copy paper on which the toner image is transferred is separated from the surface of the drum 100 by the separating charger 18 and the separating claw 19. Then, the toner image on the paper is fixed by a fixing device (not shown) and the paper is discharged to the outside of the apparatus.

On the other hand, the specified zone on the surface of the drum 100 on which the toner image formed and from which it is transferred to the paper is moved to a position confronting with the cleaning device 20 so that residual toner on the zone thereof is scraped off therefrom with a blade 21.

Sequentially, residual charge on the zone of the surface of the drum 100 is erased at a position confronting with an eraser device (not shown) thereby for next development.

A transporting force in a direction shown by an arrow (e) in FIG. 2 is applied to the used toner collected by the cleaning device 20 by the screw 22 driven for rotation by the motor 28 so that the used toner is transported from the cleaning device 20 to the path 23.

Sequentially, the used toner is supplied from the path 23 to the pipe 24 to be transported in a direction shown by an arrow (f) in FIG. 2 on the basis of rotation of the screw 25. Then, the used toner is transported to the replenishment path 26 through the opening 27 to be transported therefrom to the path 8.

The used toner transported in the path 8 is circularly transported in the paths 7 and 8 on the basis of rotation of the screw 15 and the bucket roller 13. During transportation thereof, the used toner is mixed and agitated with the carriers, charged again, and then, supplied to the surface of the sleeve 10.

The used toner includes dischargeable toner collected by the cleaning device 20 which does not obtain a charge with the specified polarity. It is possible that the dischargeable toner is attached to the non-image zone on the surface of the drum 100 at the region $X_1$ in developing.

Most of the toner supplied to the zone of the surface of the drum 100 at the region $X_1$ is scraped off by the magnetic brush held on the surface of the sleeve 10.

The dischargeable toner held on the surface of the sleeve 10 at the region $X_2$ of the second developing device 2 is mixed and agitated with the carriers in the second developing device 2 to be supplied to the surface of the drum 100. Here, since the packaged density ($P.D._2$) at the region $X_2$ is smaller than that ($P.D._1$), lots of amount of the dischargeable toner are not supplied to the drum 100 at a short time and a very small amount of the toner is supplied to the non-image zone of the surface of the drum 100 at the region $X_2$ during one development.

Therefore, even though the dischargeable toner is transferred to the copy paper, visible fog which causes the quality of a reproduced image to lower does not appeared because of a very small amount of the dischargeable toner.

Next, experiments 1 and 2 for detecting fog on a non-image zone of a copy paper are executed in a first and second cases where the devices 1 and 2 each set to the condition described below are solely driven to form both reproduced images of original lines of 100 μm width and 50 μm width and a third case where both of the devices 1 and 2 are simultaneously driven in a manner described above to develop the same electrostatic latent image to form the both reproduced images thereof by each of the devices 1 and 2.

EXPERIMENT 1

Experimental Condition

1. Photosensitive drum 100
   the peripheral speed: 150 mm/sec;
2. Developing sleeve 10
   the outer diameter: 24.5 mm,
   the rotation frequency: 143.64 rpm,
   the developing gaps Ds:
   $Ds_1=0.8$ mm, $Ds_2=0.6$ mm,
   the height regulating gaps Db:
   $Db_1=0.5$ mm, $Db_2=0.45$ mm,
   a gap between the sleeve 10 and the bottom casing 3:1.0 mm,
   the developing bias ($V_B$):
   $V_{B1}=-20$(V), $V_{B2}=-150$(V);
3. Magnetic element 11
   the magnetic force of a main pole N confronting with the sleeve 10:1,000 G,
   the magnetic force of the other poles: 500–800 G, where G denotes Gauss;
4. Bucket roller 13
   the outer diameter: 34 mm,
   the rotation frequency: 179.55 rpm;
5. Screw 15
   the outer diameter: 20.0 mm,
   the rotation frequency: 100 rpm;
6. Developer
   the toner: positively chargeable, insulated, and non-magnetic toner,
   the carrier: the average grain diameter of 57 μm, binder type insulated magnetic carrier, the resistance of $10^{13}$ Ω·cm.

Experimental Result

Figure 3:
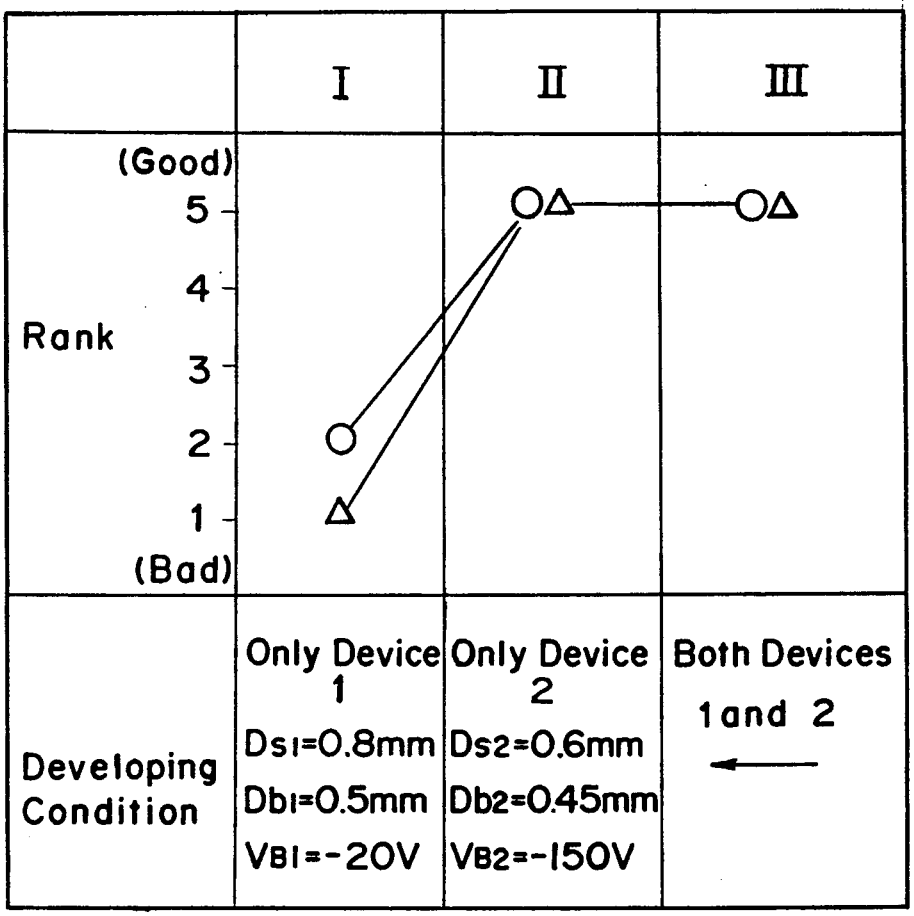
FIGS. 3 and 4 are, respectively, graphs of the results of the experiment 1 and 2.

The result of the experiment 1 is shown in FIG. 3. In FIG. 3, "Δ" indicates a result of the experiment with respect to the original line of 100 μm width and "O" indicates a result of the experiment with respect to the original line of 50 μm width.

As a result, in column I which corresponds to the first case where only the first developing device 1 set in such a condition that the gap $Ds_1$ is 0.8 mm, the gap $Db_1$ is 0.5 mm, and $V_{B1}$ is −20 (V) is driven for development, the rank of fog on the non-image zone with respect to the line of 100 μm width is 1, the rank thereof with respect to the line of 50 μm width is 2, and the fog is noticeably appeared with respect to both lines in the first case.

In column II which corresponds to the second case where only the second developing device 2 set in such a condition that the gap $Ds_2$ is 1.2 mm, the gap $Db_2$ is 0.45 mm, and $V_{B2}$ is −150 (V) is driven for development, both the ranks of fog on the non-image column with respect to the lines of 100 μm width and 50 μm width are 5 and no fog is appeared with respect to both lines in the second case.

In column III which corresponds to the third case where the first and second developing devices 1 and 2 are driven for development, both the ranks of fog on the non-image zone with respect to the lines of 100 μm width and 50 μm width are 5 which is the same as that in the result in the second case where only the device 2 is driven.

EXPERIMENT 2

Experimental condition

The condition in the experiment 2 is almost the same as that in the experiment 1 except that the gap $Ds_1$ is changed from 0.8 mm to 0.5 mm and the gap $Ds_2$ is changed from 0.6 mm to 1.2 mm.

Experimental Result

Figure 4:
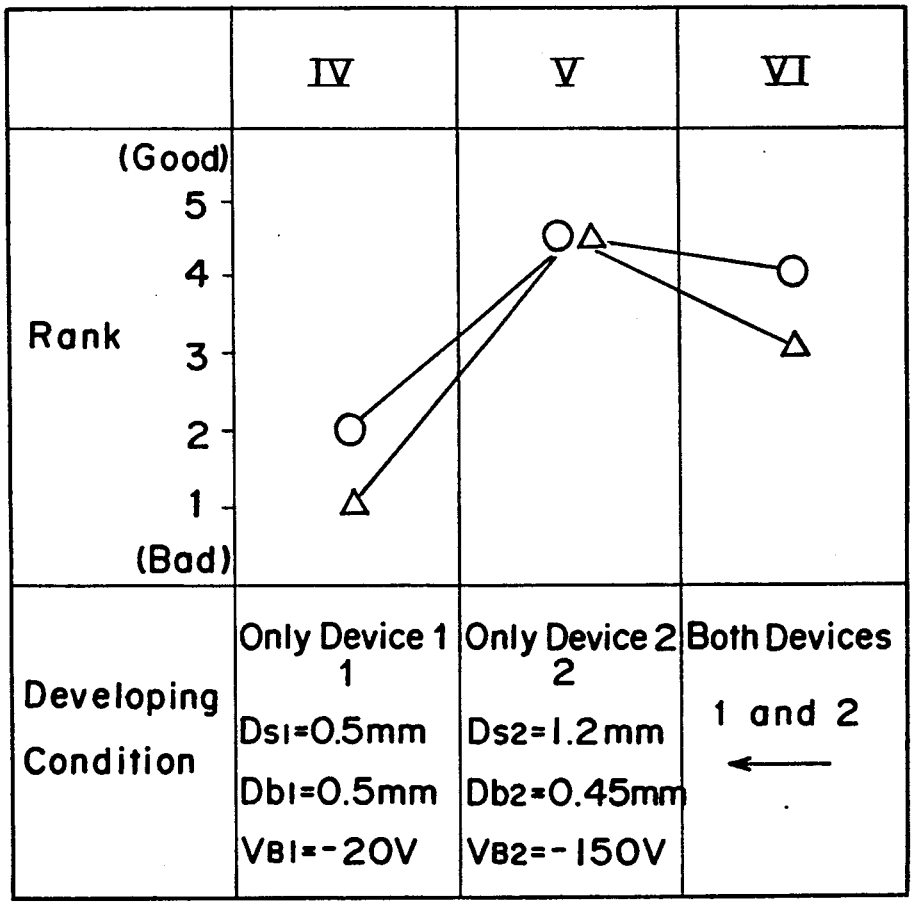

The result of the experiment 2 shows in FIG. 4. In FIG. 4, "Δ" indicates a result of the experiment with respect to the original line of 100 μm width and "O" indicates a result of the experiment with respect to the original line of 50 μm width.

As a result, the ranks of fog thereon in both the column IV corresponding to the first case where only the first developing device 1 is driven for development and the column V corresponding to the second case where only the second developing device 2 is driven for development are, respectively, similar to those in the columns I and II in both the first and second cases in the experiment 1.

The result of the third case, where both the devices 1 and 2 are driven for development, is shown the column VI of FIG. 4. The rank of fog on the non-image zone with respect to the line of 100 μm width is 3.0, the rank thereof with respect to the line of 50 μm width is 4.0, and the fog is slightly appeared in the latter. The fog amount in the former is slightly more than that in the latter but the reproduced image in the former specially has no obstacle to see by the fog.

As is clear from the above description, in the case where both the devices 1 and 2 are simultaneously driven to develop the same electrostatic latent image by each of the devices 1 and 2, the second developing device 2 has greater effect on the fog appeared on the non-image zone of the copy paper. Then, even though the toner in the device 1 is attached as fog to the surface of the drum 100 in developing, the attached toner is scraped off with the magnetic brush in the device 2 ,and thus, little fog is appeared on the copy paper.

Therefore, in the apparatus, even though the used toner collected in the cleaning device 20 is returned to the device 1, it may be prevented the reproduced image from having fog on the non-image zone of the copy paper so that the quality thereof becomes specially worse.

In the first embodiment, although the apparatus is described by that the packaged density in the device 2 is smaller than that in the device 1, in short, it is sufficient that the device 2 is employed to obtain better reproducibility of density of a reproduced image, and then, under such a condition, the packaged density in the devices 1 and 2 may be the same.

According to the arrangement of the first embodiment of the present invention, both of the devices 1 and 2 may be simultaneously driven for development to obtain a reproduced image with improvement of reproducibility of density of at least a line image, that is, a solid image and/or a line image, the used toner collected by the cleaning device 20 retransported to the first developing device 1 of which the toner consumption amount is larger than that in the device 2 to be effectively used by the device 1 without useless waste of the toner.

Even though the dischargeable toner in the used toner is supplied to the non-image zone on the surface of the drum 100 again, such a dischargeable toner is collected into the device 2, and then, the very small amount of the dischargeable toner is supplied to the surface of the drum 100 by the device 2 to prevent noticeable appearance of the fog on the non-image zone of the copy paper.

Figure 5:
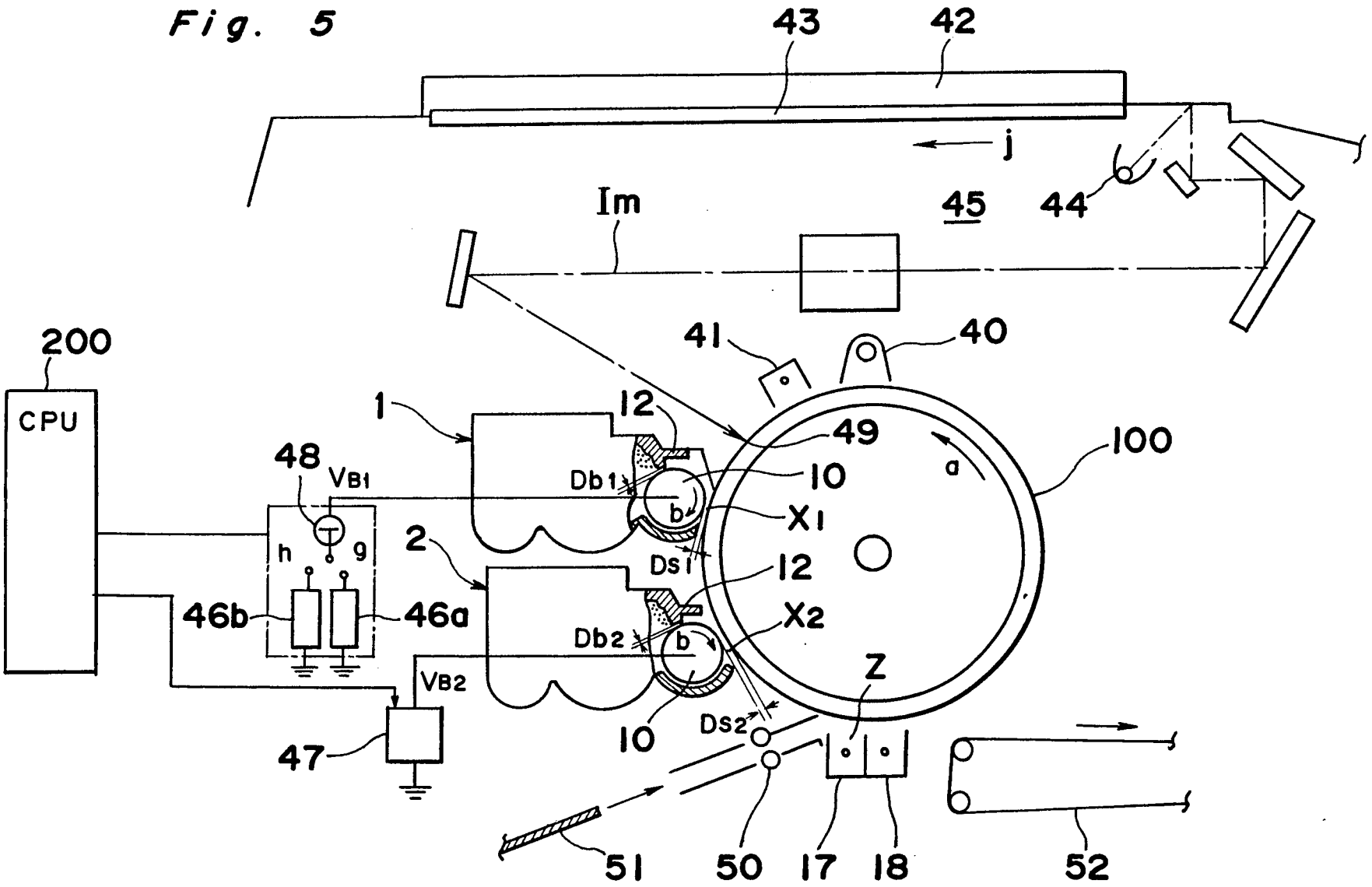
FIG. 5 is a sectional view of a main part of an image forming apparatus according to the second embodiment of the present invention.
Figure 6:
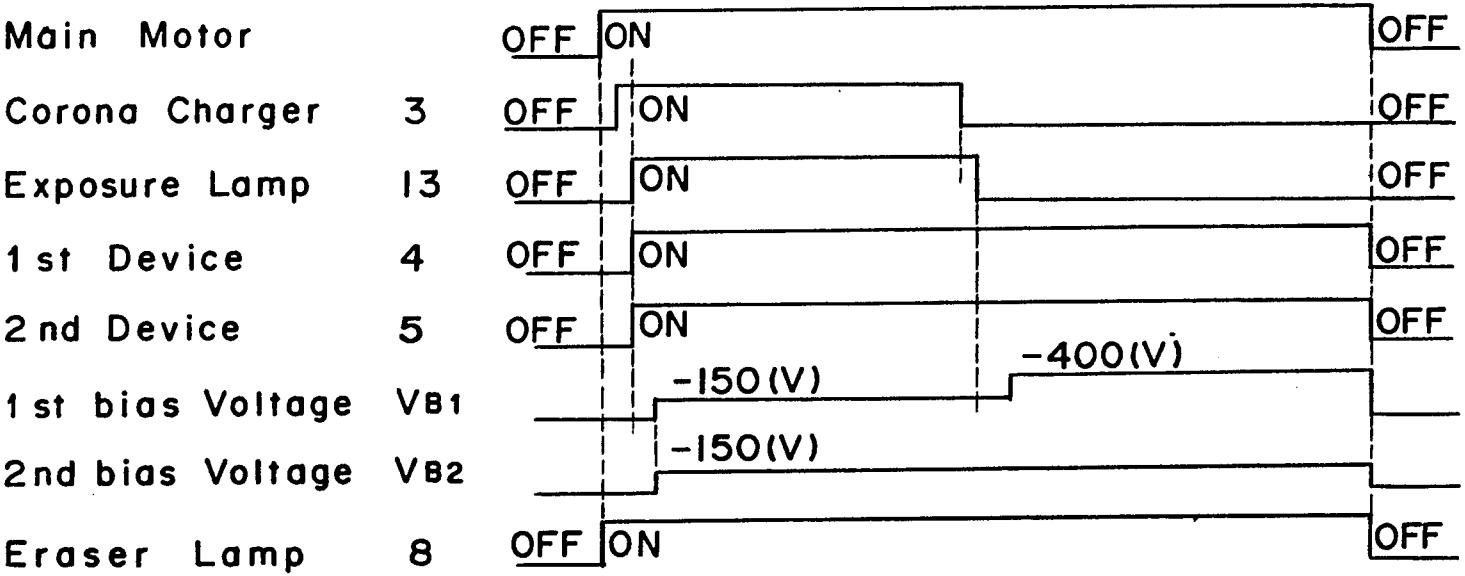
FIG. 6 is a timing chart of the copy operation of the apparatus shown in FIG. 5.

Next, FIGS. 5–7 show an image forming apparatus according to the second embodiment of the present invention.

FIG. 5 is a sectional view showing the main part of the apparatus in which the peripheral length of the drum 100 is larger than the longest longitudinal length of a usable copy paper 51 in the apparatus.

A corona charger 41, the first developing device 1, the second developing device 2, the transfer charger 17, the separating charger 18, and an eraser lamp 40 are disposed around the drum 100.

An optical system 45 with an exposure lamp 44 is disposed above the drum 100 and below an original document platform 43 covered with a cover 42 for opening and closing the platform 43.

The devices 1 and 2 are the same as those in the first embodiment. The developing sleeve 10 in the device 1 (referred to as "first sleeve 10" hereinafter) and the developing sleeve 10 in the device 2 (referred to as "second sleeve 10" hereinafter) are accommodated in the devices 1 and 2 to rotate in directions shown by the arrows (b), respectively. The height regulating members 12 are arranged to confront with the upper circumferential surfaces of the sleeves 10 through the height regulating gaps $Db_1$ and $Db_2$, respectively.

The sleeves 10 are arranged to confront with the drum 100 through the developing gaps $Ds_1$ and $Ds_2$, respectively. The developer packaged density ($P.D._1$) at the region $X_1$ confronting the first sleeve 10 with the drum 100 is larger than that ($P.D._2$) at the region $X_2$ confronting the second sleeve 10 with the drum 100.

A developing bias voltage $V_{B1}$ of one of the power sources 46*a* and 46*b* and a developing bias voltage $V_{B2}$ of a power source 47 are applied to the first and second sleeves 10, respectively. The voltage $V_{B1}$ applied to the first sleeve 10 is selectively changed between two different voltages. That is, the mode of a switch (T) 48 is changed from one state connecting with a contact (g) to the other state connecting with a contact (h) so that only the developing bias voltage −400 (V) of the power source 46*b* is applied to the first sleeve 10, while the mode of the switch (T) 48 is changed from the other state connecting with the contact (h) to the one state connecting with the contact (g) so that only the developing bias voltage −150 (V) of the power source 46*a* is applied to the first sleeve 10. The voltage of the power source 46*b* is higher than that of the power source 46*a*. An on-off operation of the voltages applied to the first and second sleeves 10 and an on-off operation of the switch 48 are controlled by a central processing unit CPU 200 for controlling the copy operation of the apparatus. The mode of the switch 48 is changed into the state connecting with the contact (g) at the start of the copy operation.

FIG. 6 shows a time chart of the copy operation of the apparatus.

On depressing a print switch (not shown), a main motor (not shown) is switched on to start driving. Then, the drum 100 starts rotating in the direction shown by the arrow (a) to switch on the corona charger 41 so as to charge the surface of the drum 100 into such a specified polarity that the electric potential Vo of the surface thereof is −500 (V).

Sequentially, the exposure lamp 44 is moved in a direction shown by an arrow (j) during turning-on of the lamp 44 to project a light onto an original document placed on the platform 43, while performing the scanning operation in the same direction. Then, a light (Im) reflected from the original document is projected onto the specified zone of the surface of the drum 100 through lenses and mirrors at an exposure point 49 to form an electrostatic latent image corresponding to the image of the original document thereon.

Then, both the devices 1 and 2 are driven at the same time that the specified bias voltages $V_{B1}$ and $V_{B2}$ of −150 (V) of the power sources 46*a* and 47 are applied to the sleeves 10, respectively. On the basis of an electric potential difference between the surface potential of the drum 100 and the developing bias voltages $V_{B1}$ and $V_{B2}$, the positively charged toner is electrostatically supplied to the surface of the drum 100.

Here, the packaged density ($P.D._1$) at the region $X_1$ is larger than that ($P.D._2$) at the region $X_2$.

Therefore, the toner is frequently contacted with the latent image at the region $X_1$ to form a toner image with sufficient density. Although the developing efficiency at the region $X_1$ is higher than that at the region $X_2$, the toner attached to the surface of the drum 100 is frequently scraped off with the magnetic brush and specially, the toner attached to the latent image of a line image is easily scraped off as compared with the toner attached to the latent image of a solid image and/or that of a normal literal image. The latent image from which the toner is scraped off has still been maintained in a charging state.

Then, the toner, in the device 2, in the same color as that in the device 1 is supplied to the toner image formed at the region $X_1$ in the manner described above and the part of the latent image from which the toner is scraped off Here, since the packaged density ($P.D._2$) is smaller than that ($P.D._1$), the toner in the device 2 is not frequently contacted with the toner image on the drum 100.

Therefore, the toner attached to the surface of the drum 100 is seldom scraped off with the magnetic brush. Thus, even though the toner image corresponds to an original line image, the toner is attached to the toner image to be sufficiently developed in a visible image.

According to the above description, the latent images, corresponding to the normal literal image and the solid image, passed through the regions $X_1$ and $X_2$ are developed to form the reproduced images with sufficient density, respectively and the latent image corresponding to the line image is developed to form the sufficiently visible reproduced image.

Each toner image formed at the regions $X_1$ and $X_2$ is transported to a transfer region Z confronting it with the transfer charger 17. The copy paper 51 is transported by timing rollers 50 to the region Z in timed relation with respect to the toner image on the basis of discharge of the transfer charger 17 so that the toner image is transferred on the paper 51.

The paper 51 on which the toner image is transferred is separated from the surface of the drum 100 by discharge of the separating charger 18 before it is transported to a fixing device (not shown) through a conveyer 52. The toner image is melted, and then, fixed on the paper 51 in the fixing device before the paper 51 is discharged to a discharge unit (not shown).

On the other hand, after completion of both of the scanning operations of the exposure lamp 44 for a specified period of time and the exposure of all the image to be reproduced, the corona charger 41 and the exposure lamp 44 are switched off in order. Since the peripheral length of the drum 100 is larger than the longest longitudinal length of a usable copy paper 51 to be ready for the copy operation, an electrostatic latent image corresponding to the image on the one end of the original document in the scanning direction does not reach the exposure point 49 at the time of completion of the scanning operation.

When an electrostatic latent image corresponding to the image on the other end of the original document in the scanning direction passes through the region $X_1$, the mode of the switch 48 is changed from one state connecting with the contact (g) to the other state connecting with the contact (h) so that the developing bias voltage $V_{B1}$ is changed from the power source 46*a* of −150 (V) to the power source 46*b* of −400 (V).

On the other hand, the eraser lamp 40 is maintained in a switching-on state from the start of the main motor and residual charge on a zone, which has passed through the transfer region Z, of the surface of the drum 100 is erased by projection of the eraser lamp 40 for next development.

Here, the positively charged toner not to be transferred on the paper 51 is still remained on the surface of the drum 100 after the transferring operation and are not completely removed therefrom by projection of the eraser lamp 40. Then, the toner with positive charge is still electrostatically attached to the surface of the drum 100.

The zone of the surface of the drum 100 reaches the developing region $X_1$ through a position confronting with the eraser lamp 40 and a position confronting with the corona charger 41.

At the developing region $X_1$ is contacted the magnetic brush held on the surface of the sleeve 10 rotating in the direction shown by the arrow (b) with the surface of the drum 100. The charged toner on the surface of the drum 100 which is not transferred on the paper is scraped off with the magnetic brush. The toner which is not transferred thereon is positively charged and the developing bias voltage $V_{B1}$ of −400 (V) is applied to the sleeve 10. Then, the charged toner is electrically attracted to the sleeve 10 to weaken adhesion between the charged toner and the drum 100 so that the toner is readily scraped off with the magnetic brush therefrom.

Therefore, the zone of the surface of the drum 100 passed through the developing region $X_1$ is cleaned in a state where little toner to be transferred on the paper is remained.

As described above, after at least a zone forms the latent image corresponding to the image of an original document on the outer circumferential surface of the drum 100 is cleaned at the region $X_1$, the main motor and the first and second developing devices 1 and 2 are stopped and the switch 48 is turned off to cut the electrical connection between each sleeve 10 and either power source 46*a*, 46*b*, or 47. Then, the voltages $V_{B1}$ and $V_{B2}$ are not applied to the sleeves 10 and the copy operation is completed.

The packaged density ($P.D._1$) in the device 1 is set to be larger than that ($P.D._2$) in the device 2 under the following condition to which the devices 1 and 2 are set. The condition is the same as that in the Experiment 1 except that the developing gap $Ds_1$ is 0.4 mm, the developing gap $Ds_2$ is 1.2 mm, the voltage $V_{B1}$ is selectively changed between −150 (V) and −400 (V), the voltage is −150 (V). Then, the experiment for detecting reproducibility RLI of density of a line of 100 μm width and a line 50 μm width and reproducibility RSI of density of a solid image in a first and second cases where each of the devices 1 and 2 is driven by itself and a third case where both the devices 1 and 2 are simultaneously driven to develop the same electrostatic latent image by each of the devices 1 and 2, respectively, is executed. The image of the original document is formed by drawing the plural lines of 50 μm width and the plural lines of 100 μm width crosswise. The reproducibility of the lines drawn in the direction intersecting perpendicularly to the copy-paper-transferring direction is detected as the reproducibility RLI of density of a line image referring to the following standard described in the Table.

TABLE

| Rank | Evaluation<br>Complete reproduction of line with |
|---|---|
| 1 | RSI 1.5 |
| 2 | RSI 1.5–1.2 |
| 3 | RSI 1.5–0.9 |
| 4 | RSI 1.5–0.6 |
| 5 | RSI 1.5–0.4 |

The result of the experiment 3 is shown in FIG. 7.

As a result, the reproducibility RLI of the density of the line image in the first case where the first developing device 1 is solely driven shows at the column VII in FIG. 7. The reproducibility RLI of the line of 100 μm width is a rank of 4.5, the reproducibility RLI of the line width is a rank of 3.5, and the reproducibility RSI of the density of the solid image is 1.47.

The reproducibility RLI of the density of the line image in the second case where the second developing device is solely driven shows at the column VIII in FIG. 7. The reproducibility RLI of the line of 100 μm width is a rank of 5, the reproducibility RLI of the line of 50 μm width is a rank of 4.5, and the reproducibility RSI of the density of the solid image is 0.62.

The reproducibility RLI of the density of the line image in the third case where both the devices 1 and 2 are simultaneously driven to develop the same latent image is shown at the column IX in FIG. 7. The reproducibility RLI of the line of 100 μm width is a rank of 5 and the reproducibility RLI of the line of 50 μm width is a rank of 4.5. These results are the same as those in the second case. The reproducibility RSI of the density of the solid image in the third case is 1.48. This result is almost the same as that in the first case.

Then, in the third case where the device 1 with higher packaged density ($P.D._1$) and the device 2 with lower packaged density ($P.D._2$) are used to develop the same latent image by both the devices 1 and 2, the reproducibility RSI of the density of the solid image is the same as that in the first case where the device 1 is solely driven. The reproducibility RLI of the density of the line image in the third case is the same as the reproducibility RLI of the density of the line image in the second case where the device 2 is solely driven. Then, in the third case, the reproduced images with improved reproducibility RSI and RLI are obtained.

According to the second embodiment, since a cleaning device is not necessary to be arranged at the side of the drum 100, a space for arranging the cleaning device is unnecessary even though two developing devices are arranged at the side of the drum 100 to obtain a high quality image, so that the apparatus is smaller in size.

In both the embodiments, although the packaged density (P.D.) at the developing region in each of the devices 1 and 2 is adjusted with the developing gaps Ds, the amount of the developer transported to the region $X_2$ and the density ($P.D._2$) at the region $X_2$ may be changed into smaller value than the amount of the developer and the density ($P.D._1$) at the region $X_1$ with the height regulating gap Db formed between the height regulating member 12 and the surface of the drum 100. In this case, when the experimental condition is the same as that in the condition, in the experiment 2, except that both the developing gaps in the devices 1 and 2 Ds are 0.6 mm, the height regulating gap Db in the device 1 is 0.5 mm, and the height regulating gap Db in the device 2 is 0.2 mm, the experiment for detecting fog on a copy paper is executed. The results thereof are the same as those in the experiment 2.

Next, the amount of the developer transported to the region $X_2$ and the density ($P.D._2$) at the region $X_2$ may be changed into smaller value than the amount of the developer and the density ($P.D._1$) at the region $X_1$ with speed ratio of the peripheral speed of the drum 100 or the peripheral speed of the sleeve 10 to a process speed as a travel speed of a scanning system (not shown) having an optical system and a traveling type original document platform In this case, when the experimental condition is the same as that in the condition, in the experiment 2, except that both the developing gaps Ds in the devices 1 and 2 are 0.6 mm, both the height regulating gap Db in the devices 1 and 2 are 0.5 mm, the peripheral speed of the sleeve 10 in the device 1 is 262.5 mm/sec, and the peripheral speed of the sleeve 10 in the device 2 is 187.5 mm/sec, the experiment for detecting fog on a copy paper is executed. The results thereof are the same as those in the experiment 2.

Figure 8:
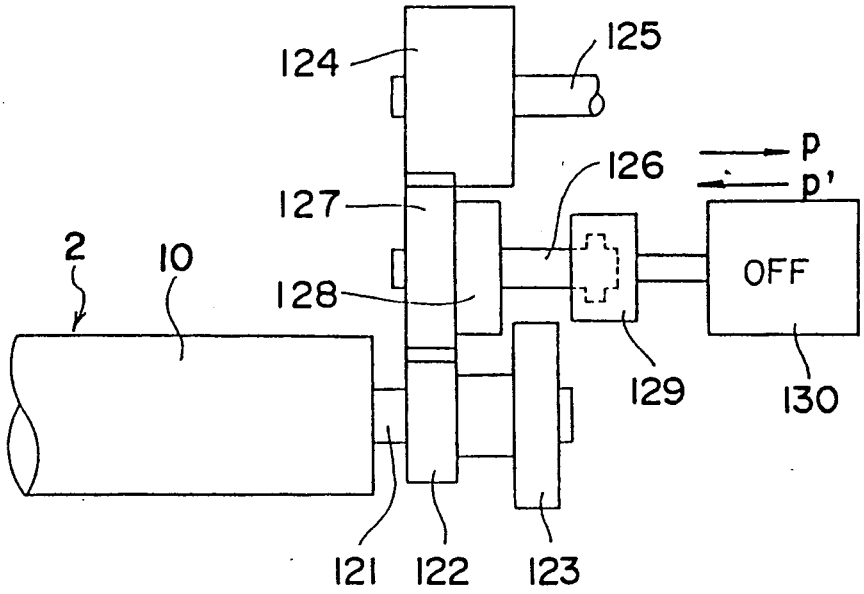
FIGS. 8 and 9 are side views of a speed changing mechanism of an image forming apparatus according to the another embodiment of the present invention.
Figure 9:
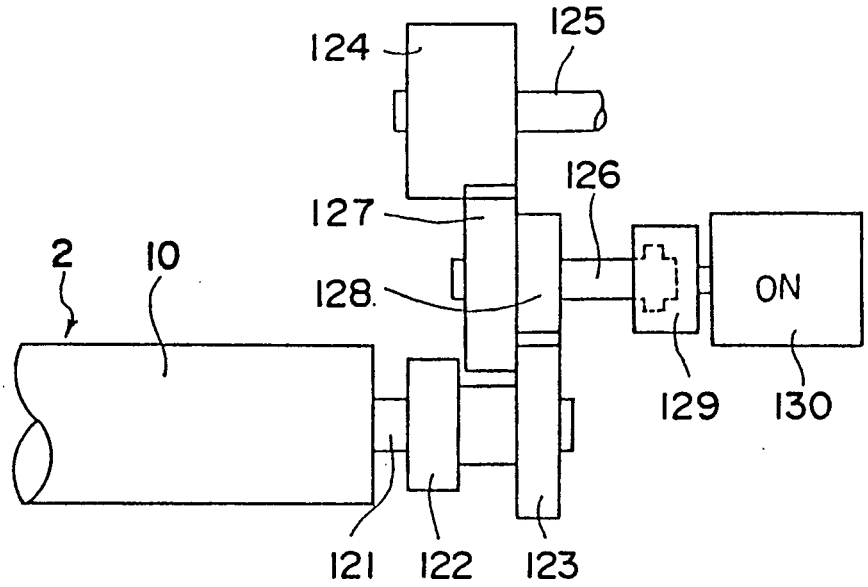

FIGS. 8 and 9 show a speed changing mechanism for changing the peripheral speed of the sleeve 10 in the device 2.

A small high speed gear 122 with the number of teeth $n_1$ and a larger low speed gear 123 with the number of teeth $n_2$ are fixed to one end of a support shaft 121 of the sleeve 10. The number of teeth $n_2$ is larger than that $n_1$.

A gear 124 is fixed to one end of a shaft 125 operatively connected with a drive shaft (not shown).

Furthermore, a larger high speed gear 127 with the number of teeth $n_3$ and a smaller low speed gear 128 with the number of teeth $n_4$ are fixed to one end of a shaft 126 to rotate the gears 127 and 128 with the shaft 126. The gear 128 is integrally fixed to the gear 127. The number of teeth n is larger than that $n_4$. The shaft 126 is connected with a plunger of a solenoid 130 through a connecting device 129. The solenoid 130 is controlled to be driven by a central processing unit CPU (not shown)

According to the arrangement of the mechanism described above, as shown in FIG. 8, in the state where the solenoid 130 is turned off, the high speed gear 127 engages with gear 124 and the high speed gear 122 to transmit the drive force outputted from the shaft 125 to the support shaft 121 of the sleeve 10 through the gears 124, 127, and 122. In this state, the sleeve 10 in the device 2 is driven for rotation at the same speed as the sleeve 10 in the device 1.

Next, when the solenoid 130 is turned on in the state shown in FIG. 9, the shaft 126 moves in a direction shown in an arrow (p) to release only the engagement between the gears 127 and 122 while the gear 127 engages with the gear 124 and to engage the low speed gear 128 with the gear 123 as shown in FIG. 9. Therefore, the rotary power of the shaft 125 is transmitted to the support shaft 121 of the sleeve 10 through the gears 124, 127, 128, and 123.

Here, the numbers of teeth of the gears 122 and 123 are $n_1$ and $n_2$, respectively, and the former $n_1$ is smaller than the latter $n_2$. The numbers of teeth of the gears 127 and 128 are $n_3$ and $n_4$, respectively, and the former $n_3$ is larger than the latter $n_4$. Therefore, when the solenoid 130 is changed from the turning-off state to the turning-on state according to the signal outputted from the unit CPU, the sleeve 10 in the device 2 is driven for rotation at lower peripheral speed as compared with the sleeve 10 in the device 1. Conversely, when the solenoid 130 is changed from the turning-on state to the turning-off state according to the signal outputted from the unit CPU, the sleeve 10 in the device 2 is driven for rotation at higher peripheral speed as compared with the sleeve 10 in the device 1.

Although the present invention has been fully described in connection with the preferred embodiments thereof with reference to the accompanying drawings, it is to be noted that various changes and modifications are apparent to those skilled in the art. Such changes and modifications are to be understood as included within the scope of the present invention as defined by the appended claims unless they depart therefrom.

What is claimed is:

1. An image forming apparatus comprising:

a photosensitive member supported to rotate in one direction;

a first developing means accommodating a developer in a specified color and set to develop an electrostatic latent image reproduced as a solid;

a second developing means arranged at a downstream side of said first developing means in the one direction of said member, said second developing means accommodating a developer in the same color as that in said first developing means and being set to develop an electrostatic latent image reproduced as a line;

a cleaning means for collecting the developer remaining on a surface of said member; and a developer transporting means for transporting the developer collected by said cleaning means to said first developing means.

2. An image forming apparatus as claimed in claim 1, wherein each of said first and second developing means has a developing sleeve rotatably arranged at a specified distance to confront with said member and the distance between said member and the sleeve in said second developing means is set to be larger than that between said member and the sleeve in said first developing means.

3. An image forming apparatus as claimed in claim 1, wherein each of said first and second developing means has a developing sleeve rotatably arranged at a specified distance to confront with said member and a peripheral speed of the sleeve in said first developing means is set to be faster than that of the sleeve in said second developing means.

4. An image forming apparatus as claimed in claim 1, wherein each of said first and second developing means has a developing sleeve rotatably arranged at a specified distance to confront with said member and a height regulating member arranged at a specified distance to confront with the sleeve, and the distance between the height regulating member and the sleeve in said first developing means is set to be larger than that between the height regulating member and the sleeve in said second developing means.

5. An image forming apparatus comprising:

a photosensitive member supported to rotate in one direction;

a charging means for uniformly charging a specified zone of a surface of said member;

an image forming means for forming an electrostatic latent image on the uniformly charged specified zone of the surface of said member;

a first developing means accommodating a developer in a specified color and set to develop at a developing region thereof an electrostatic latent image reproduced as a solid under applying a first developing bias voltage thereto;

a voltage changing means for selecting a first developing bias voltage and a second developing bias voltage which is higher than the first developing bias voltage and applying the selected voltage to said first developing means;

a second developing means arranged at a downstream side of said first developing means in the one direction of said member, said second developing means accommodating a developer in the same color as that in said first developing means and being set to develop an electrostatic latent image reproduced as a line; and a control means for controlling such an operation of said voltage changing means that the first developing bias voltage is applied to said first developing means thereby while the latent image formed on the specified zone of the surface of said member passes through the developing region of said first developing means and that the second developing bias voltage is applied to said first developing means thereby while the specified zone passes through the developing region of the first developing means after the latent image passes through the developing region of the first developing means.

6. An image forming apparatus as claimed in claim 5, further comprising:

a transfer means for transferring an image developed by said first and second developing means to a copy paper, said transfer means being arranged around said member and between said second developing means and said charging means in the rotary direction of said member; and an eraser means for erasing residual charge remained on the specified zone of the surface of said member.

7. An image forming apparatus as claimed in claim 5, wherein each of said first and second developing means has a developing sleeve rotatably arranged at a specified distance to confront with said member and the distance between said member and the sleeve in said second developing means is set to be larger than that between said member and the sleeve in said first developing means.

8. An image forming apparatus as claimed in claim 5, wherein each of said first and second developing means has a developing sleeve rotatably arranged at a specified distance to confront with said member and a peripheral speed of the sleeve in said first developing means is set to be faster than that of the sleeve in said second developing means.

9. An image forming apparatus as claimed in claim 5, wherein each of said first and second developing means has a developing sleeve rotatably arranged at a specified distance to confront with said member and a height regulating member arranged at a specified distance to confront with the sleeve, and the distance between the height regulating member and the sleeve in said first developing means is set to be larger than that between the height regulating member and the sleeve in said second developing means.

10. An image forming apparatus comprising:

a photosensitive member supported to rotate in one direction;

a first developing means for developing an electrostatic latent image formed on said member by a developer accommodated therein;

a second developing means for developing the electrostatic latent image by a developer accommodated therein, which is so provided as to be located at a downstream side of said first developing means in the one direction of rotation of said member; and a developer collecting mechanism for removing the developer remaining on a surface of said member therefrom to collect it and to return to said first developing means.

11. An image forming apparatus as claimed in claim 10, wherein said mechanism comprising:

a cleaning means for collecting the developer remained on the surface of said member; and a developer transporting means for transporting the developer collected by said cleaning means to said developing means arranged at the upstream side of said member.

12. An image forming apparatus as claimed in claim 10, wherein each of said first and second developing means accommodates the same developer in color and is set so as to develop at each developing region said electrostatic latent image depending on different developing conditions.

13. An image forming apparatus as claimed in claim 10, wherein each of said first and second developing means has a developing sleeve rotatably arranged at a distance to confront with said member and the conditions is defined that developer packaged density (P.D.) in said upstream developing means of the rotary direction of said member is larger than that (P.D.) in said downstream developing means thereof, the density being defined by an equation which is $$\text{density } (P.D.) = Vd/Ds,$$

where Vd is an amount of the developer passed through each developing region of each developing means per hour, and Ds is a distance between the surface of said member and a surface of the sleeve.

14. An image forming apparatus comprising:

an image bearing member supported to rotate in one direction;

an image forming means for forming an electrostatic latent image on the surface of said image bearing member;

plural developing means arranged around said image bearing member, each developing means accommodating a developer of the same color and being set to develop at each developing region an electrostatic latent image depending on different developing conditions, and both of said developing means simultaneously driven to develop the same electrostatic latent image;

a cleaning means for collecting the developer remaining on the surface of said image bearing member; and a developer transporting means for transporting the developer collected by said cleaning means to one of said developing means arranged at an upstream side thereof in a rotary direction of said image bearing member.

* * * * *